US005243841A

United States Patent [19]

Fleissner

[11] Patent Number: 5,243,841

[45] Date of Patent: Sep. 14, 1993

[54] DEVICE FOR APPLYING A FILM OF LIQUID FILM TO A WEB OF GOODS

[75] Inventor: Gerold Fleissner, Chur, Switzerland

[73] Assignee: Vepa Aktiengesellschaft, Riehen, Switzerland

[21] Appl. No.: 747,147

[22] Filed: Aug. 19, 1991

[30] Foreign Application Priority Data

Aug. 18, 1990 [DE] Fed. Rep. of Germany ..... 4026198

[51] Int. Cl.[5] ..... D06B 1/06

[52] U.S. Cl. ..... 68/205 R; 118/325; 239/553.3; 239/553.5

[58] Field of Search ..... 68/200, 205 R; 118/324, 118/325, DIG. 4; 239/553.3, 553.5

[56] References Cited

U.S. PATENT DOCUMENTS

| | | | |
|---|---|---|---|
| 3,610,201 | 10/1971 | Meyer | 118/324 X |
| 3,717,121 | 2/1973 | Bruckbauer et al. | 118/324 |
| 3,930,465 | 1/1976 | Schuierer | 68/200 X |
| 4,297,860 | 11/1981 | Pacifici et al. | 68/200 |
| 4,454,617 | 6/1984 | Moates et al. | 118/325 X |
| 4,547,921 | 10/1985 | Otting et al. | 68/205 R X |
| 4,572,435 | 2/1986 | Thompson | 239/553.5 |
| 4,656,845 | 4/1987 | Fleissner | 68/205 R |
| 5,048,314 | 9/1991 | Keller et al. | 68/205 R |

FOREIGN PATENT DOCUMENTS

| | | | |
|---|---|---|---|
| 553011 | 4/1977 | U.S.S.R. | 118/325 |

*Primary Examiner*—Philip R. Coe

*Attorney, Agent, or Firm*—Antonelli, Terry, Stout & Kraus

[57] ABSTRACT

A device for applying a laminar flowing liquid film of considerable width, the film being uniformly thin over the working width, to a continuously advanced web of goods includes a liquid distribution device supplied with liquid fed by a pump and provided with a plurality of liquid distribution chambers and an associated guide surface from which the liquid film flows onto the web of goods. The liquid distribution chamber is connected by a supply line with the pump and the guide surface extend over a working width greater than the cross section the of supply line. Each liquid distribution chamber extend only over an exactly defined working width which is narrow by comparison with the width of the wider web of goods, and each chamber is connected with only one liquid supply line.

12 Claims, 3 Drawing Sheets

DEVICE FOR APPLYING A FILM OF LIQUID FILM TO A WEB OF GOODS

BACKGROUND OF THE INVENTION

This invention relates to a device for applying a laminar flowing film of liquid, uniformly thin over a working width of the device, to a continuously advanced web of goods which includes a liquid distributing device supplied with liquid fed by a pump, with a liquid distribution chamber and an associated guide surface possibly provided with an overflow weir, from whose lower edge the film of liquid runs onto the web of goods e.g. textile goods including woven and non-woven materials, as it flows away; said liquid distribution chamber being connected by a supply line with the pump and extending toward the guide surface over a working width that is made greater than the cross section of the supply line.

A device of this kind is known from DE 35 22 320 A1 and corresponding U.S. Pat. No. 4,656,845. This device has the advantage that it allows a fast change of the application liquid, e.g. dye, colorant or the like, in terms of its nature or color, without the previously necessary downtime or production of reject materials from the web of goods to be wetted, with uniform distribution and constant quantity of application liquid over the working width being ensured. This is brought about by a liquid supply chamber connected upstream from the overflow edge, which opens out in a conically expanding fashion toward the overflow weir, but is small in volume. In this manner, the contact of the liquid supply stream which is necessary to form a laminar liquid film flows up to the overflow weir. In such a device the liquid feed flow must be calmed because the liquid volume within this liquid supply chamber is very small while the amount of liquid to be applied over the working width of more than 30 liters/min/meter of the working width is very great and hence the inflow of the liquid into this device, divided between several supply lines, is very strong.

Upstream of the liquid supply chamber of the device according to the above-mentioned disclosure document, a liquid distribution chamber is located which extends over the entire working width in the exact same fashion as the overflow weir. The liquid distribution chamber has supply lines associated with it. The liquid flowing in through these lines is distributed in the distribution chamber by a plurality of baffles or partitions over the working width. Work with a device of this kind has shown that it does provide a rapid color change, but during the transition between one color and the next, an area, albeit small, is produced on the web of goods in which the colors mix with one another, especially in the form of tongue-shaped mixtures of color in the spaces between the individual feed lines.

SUMMARY OF THE INVENTION

The goal of the invention is to develop a device in which, with the same range of goals for rapid color change and low liquid volume in an application device with the advantageous pouring principle, a linear color change is now made possible and the previously necessary volume of liquid within the device can be further reduced.

Taking its departure from the device of the type recited heretofore, the solution to the stated problem consists in the fact that the liquid distribution chamber extends over only a precisely defined working width which is narrow by comparison to the width of a wide web of goods and this chamber is connected with only one liquid supply line. Since in this working area a device is used which must distribute the liquid over a web of goods with a large working width, a plurality of these liquid distribution chambers is arranged side by side and can then cover the entire working width of the web of goods. Hence, the goal of the device according to the invention is to calm and to distribute laterally the liquid flowing through the feed line in the limited liquid distribution chamber, in such fashion that when the color is changed, no stripes composed of mixed colors will result, so that after this uniform distribution, the liquid can be allowed to flow directly to the overflow weir or even to the guide surface. Hence, there may no longer be any need for the distribution chamber required in the above-mentioned disclosure document, so that the liquid volume required in the application device can be kept much smaller.

The distribution of the liquid within this liquid distribution chamber of limited width takes place in stages and uniformly, to each individual liquid outflow opening. This uniform distribution is made possible by connecting a branch line of the same length from the liquid supply opening on both sides in the direction of the working width, the branch line having an intermediate outflow opening at the end. This intermediate outflow opening in turn has a corresponding branch, but with outflow openings located closer together, resulting in branching resembling the branches of a tree. Since distribution necessarily takes place uniformly as a result of this tree-like branching, the liquid is always uniformly distributed over the plurality of outflow openings.

One especially advantageous design for connecting the liquid distribution chamber with the tree-like branches for the liquid from the supply opening to the plurality of liquid outflow openings consists in extending the branch lines in the direction of the working width, so that the intermediate outflow openings connected to these branch lines can be made in the form of holes in correspondingly thin sheets. It is therefore especially advantageous to fill the liquid distribution chamber with a plurality of such sheets and to arrange the branch lines and holes made in these sheets in accordance with a certain program in such a way with respect to one another that the result is a uniform, tree-like branching of the lines from the feed line to the plurality of outflow openings associated with the overflow weir or directly with the guide panel.

BRIEF DESCRIPTION OF THE DRAWINGS

The accompanying drawings show two embodiments of the device according to the invention. The invention will now be described in greater detail with reference to these embodiments, with specific mention of particular inventive details wherein.

DETAILED DESCRIPTION OF THE INVENTION

Figure 1:
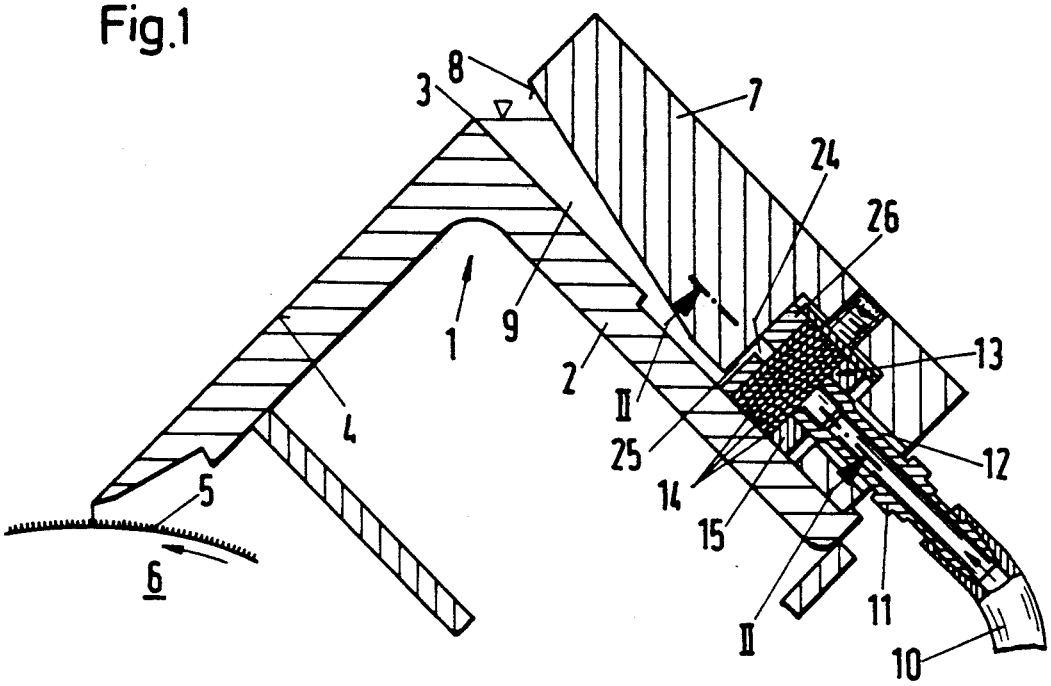
FIG. 1 is a section through the liquid application device which operates according to the pouring principle.
Figure 5:
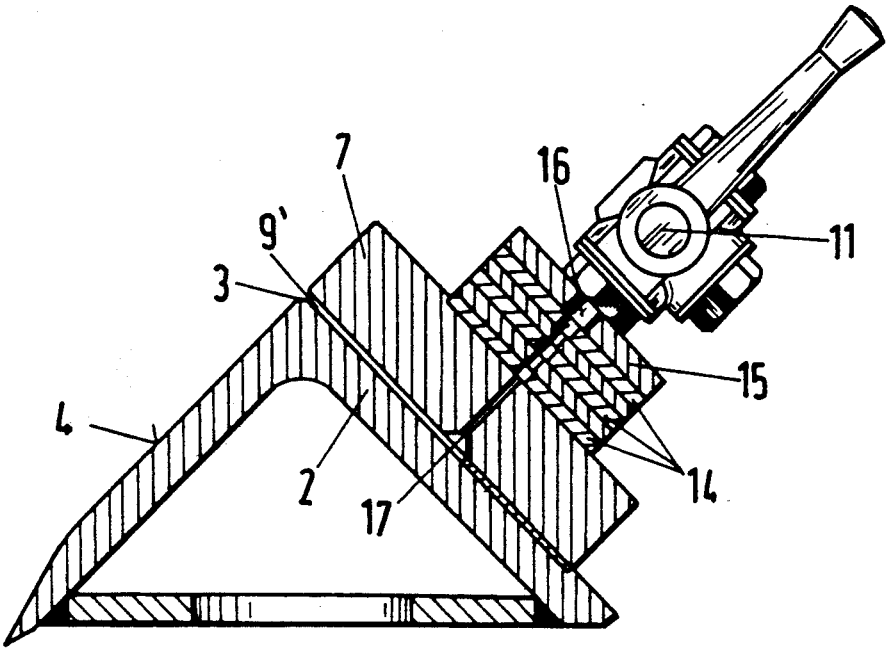
FIG. 5 shows a cross-section of the application device according to FIG. 1 with a supply chamber having a cross section that always remains constant.

The liquid application device according to FIG. 1 consists of an angle support 1, whose 90° corner is pointed upward. One leg of the angle support is a partition 2, aligned diagonally upward in the direction of overflow weir or edge 3. Guide surface 4 abuts overflow weir 3, over which a uniformly distributed liquid film runs and flows onto the web of goods 5 guided along beneath it. A web of goods 5 is supported with the nap located upwardly over a reversing roller 6. On the side opposite partition 2, a solid body or liquid application rail 7 ias located whose wall facing partition 2 serves as a diffuser wall 8. This wall 8, however, can also be aligned parallel with partition 2, forming a slot 9' as a supply chamber as shown in FIG. 5. Between the upwardly directed diffuser wall 8 and partition 2, supply chamber 9 is formed (as shown in FIG. 1), expanding conically toward overflow edge 3. The supply chamber, however, can also take the form of a slit without a cone, as shown in FIG. 5. Body 7 extends together with the other parts of dye application device 1 over a working width up to 6 meters wide and is provided over this working width with only a few supply hoses 10 through which the necessary quantity of liquid is fed to the application device by means of a pump, not shown. The device shown thus corresponds in certain aspects to that shown in DE 35 22 320 A1.

An essential feature of the device shown here is the liquid distribution system located in body 7. Hose 10 is pushed over a mouthpiece or fitting 11 mounted in body 7 in the vicinity of 12 and has its lower end screwed into the liquid distribution device 13. The liquid distribution device can also be aligned parallel to partition 2 as shown in FIG. 5, and not perpendicular to the partition. This liquid distribution device 13 is shown in detail in FIGS. 2 and 3. It consists of a plurality of panels 14 arranged parallel to one another and pressed together after assembly. Only one hole is provided in the uppermost panel 15 of this liquid distribution device 13, said hole forming liquid supply opening 16 of a liquid distribution chamber limited to the working width according to FIGS. 2 and 3. A plurality of these liquid distribution chambers are arranged side by side over the working width of the entire application device. According to FIG. 2, from each of the liquid supply openings 16, associated with a hose 10, a liquid distribution system extends to the lower side of the individual liquid distribution devices 13 which extend over an exact working width; said width, however, being only a fraction of the total width of the application device.

Distribution of the liquid flowing in through a feed opening 16 takes place in the liquid distribution chamber, which is filled with individual panels 14. In the embodiment shown, this distribution chamber has eight panels 14 arranged parallel to one another, so that the liquid flowing through supply opening 16 is distributed among a total of 16 liquid outflow openings 17. This is because the width distribution of the liquid is forced in stages from panel to panel. For this purpose, branch lines 18 and 19 of equal length are provided on both sides of liquid supply opening 16 in the direction of the working width, in FIG. 2 both to the right and to the left, with an intermediate outflow opening 20, 21 being provided at each end of said lines. These two intermediate outflow openings 20, 21 are drilled in a panel 14 located below. These two intermediate outflow openings 20, 21 are joined in turn in the same fashion on both sides in the direction of the working width, to branch lines 22, 23 which are half as long, so that liquid distribution takes place like the branches of a tree or the antlers of a deer. This distribution takes place precisely uniformly over the working width. In order not to have to install too many hoses 10 over the entire working width, approximately 10 to 20 of the liquid outflow openings 17 should have a mutual spacing of about 10 mm to one of these liquid distribution chambers.

Figure 3:
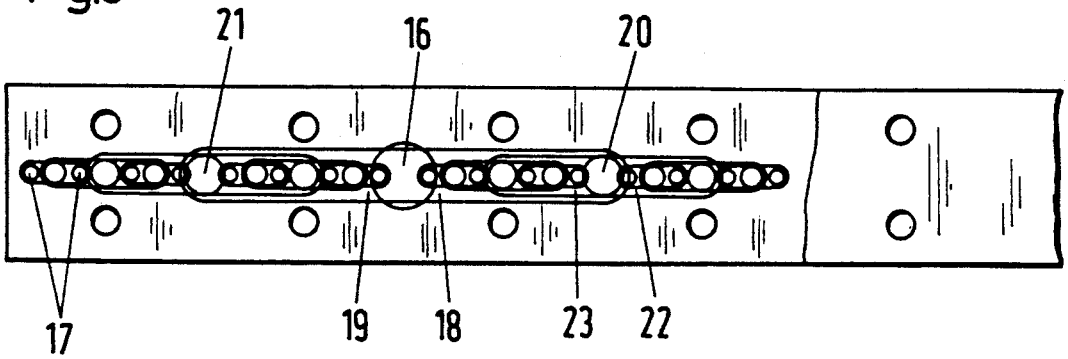
FIG. 3 is a top view of the liquid distribution device according to FIG. 2 with openings drawn partially above one another within the cross section of this liquid distribution device.

Since the liquid flowing in liquid supply opening 16 has to be distributed over a plurality of liquid outflow openings 17, the cross sections must be reduced in stages from this liquid supply opening 16 to liquid outflow openings 17. This is shown in FIG. 3. The cross section of the intermediate outflow openings 20, 21 that follow liquid supply opening 16 is cut in half, and the associated branch lines 20, 23 are accordingly made narrower in cross section than 18 and 19 above.

It has already been stated that the liquid distribution device is formed from a plurality of panels 14 arranged parallel to one another, each of said panels having either an intermediate outflow opening 20, 21 or a branch line 18, 19, 22, 23. To produce this dendriform branching of the liquid, holes 20, 21 are provided in the individual panels and branch lines 18, 19, 22, 23 are provided as holes at points such that the dendriform branching shown in FIG. 2 results after assembly.

Figure 2:
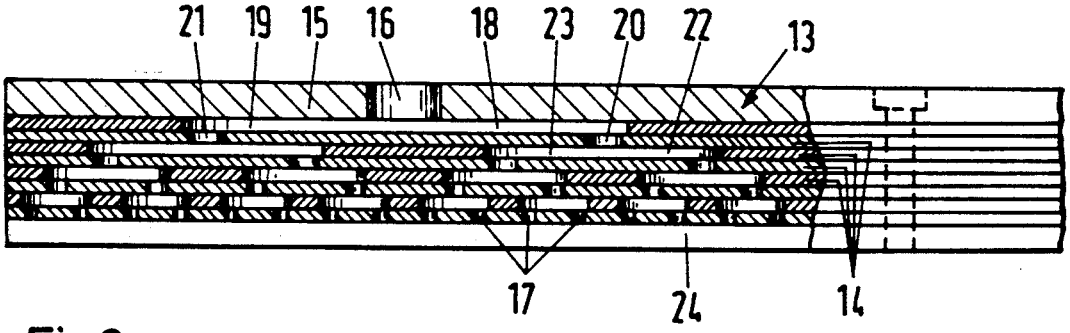
FIG. 2 is a section taken along line II—II in FIG. 1.

Division of the entire working width of 1 to 5 meters into areas corresponding to a liquid distribution chamber like that shown in FIG. 2 has the advantage that the liquid supplied through hoses 10 can be distributed exactly uniformly over a considerable working width. Depending on the working width of web of goods 5, it is then possible, by switching off individual supply hoses 10, to define the effective working width of the dye application device. A more important advantage, however, is to be able to force uniform distribution of the dye liquid over the working width without having to use a common supply chamber extending over the working width. The liquid which now emerges uniformly from liquid outflow openings 17 collects only in abutting connecting slot 24 which now extends over the entire working width of the web of goods. A pressure develops there because at this connecting slot 24 there is a liquid outflow slot 25 which likewise extends over the working width, the throughput height of said slot being less than the depth of connecting slot 24. It will be seen that the last panel or sheet 26 extends over the entire length of the application rail and that a plurality of the distribution devices 13 is arranged side-by-side over the application rail.

Figure 4:
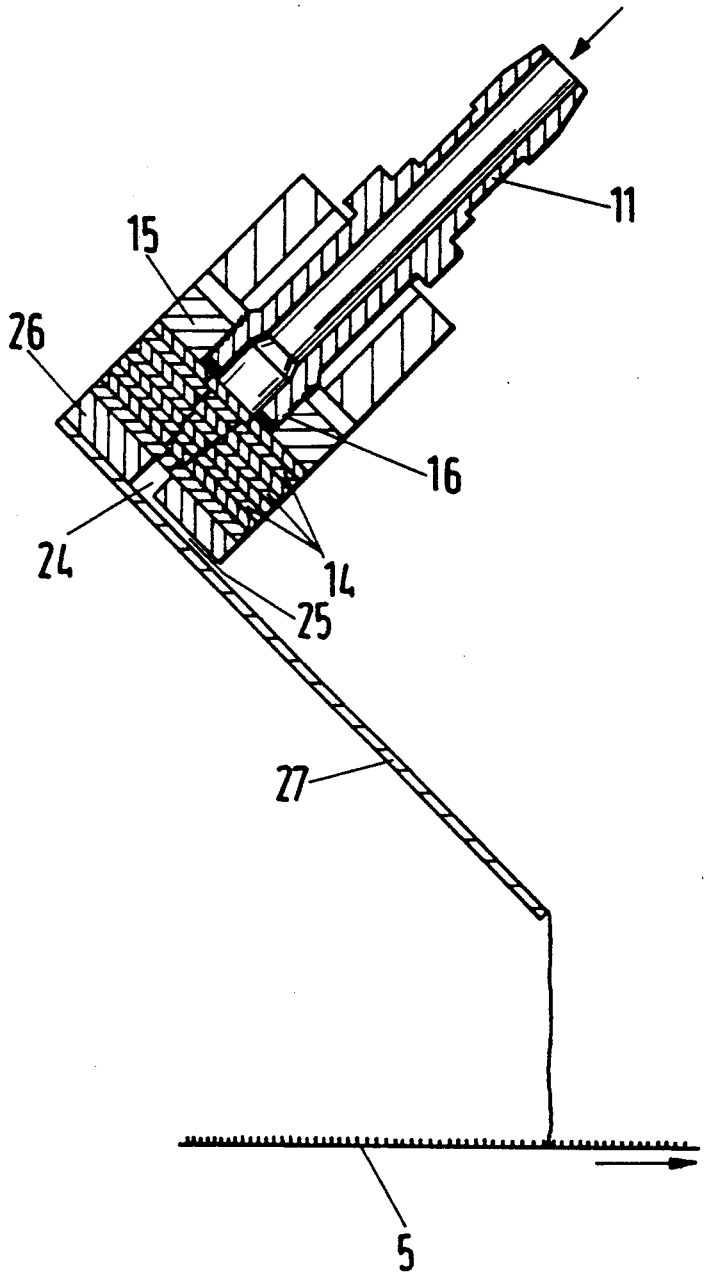
FIG. 4 is shows a cross-section or a dye application device which likewise operates according to the pouring principle, in which the liquid distribution device is associated directly with a guide panel.

From liquid outflow slot 25, the liquid flows uniformly and is distributed over the working width, out of liquid distribution device 13. Consequently, liquid supply chamber 9 shown in FIG. 1 is only conditionally necessary. This advantage is made clear in FIG. 4. Here each liquid distribution device 13 has associated with it only one guide surface in the form of a guide panel 27, by which the liquid, uniformly distributed over the working width by liquid distribution device 13, flows onto web of goods 5. In simple fashion, connecting slot 25 is formed between panel 26 of connecting slot 24 and guide panel 27. In this embodiment therefore, not only is solid body 7 with liquid supply chamber 9 eliminated, but also overflow edge 3 together with angle support 2; instead, only guide panel 27 is required to guide the uniformly distributed liquid onto the web of goods 5. This considerably reduces the volume of liquid constantly being fed to distribution device 13, and even to the application device as a whole, resulting in the desired rapid color change. In this embodiment, just as in the other embodiments, the panel 26 is attached to the uppermost sheet or panel 15 by screws (not shown).

What is claimed is:

1. A device for applying a laminar flowing liquid film of considerable width to a continuously advanced web of goods, said film being uniformly thin over a working width of the device, which comprises a liquid distribution device supplied with liquid from a supply line and provided with at least one liquid distribution chamber; an overflow weir; and a guide surface associated with said overflow weir, the liquid film flowing from a lower edge of the guide surface onto the web of goods; said liquid distribution device further comprising a liquid supply opening for connecting the liquid distribution chamber to the supply line and the guide surface extending over a working width greater than a cross section of the liquid supply opening; said liquid distribution chamber being formed by a plurality of panels arranged parallel and close to one another, each of said panels having at least one liquid outflow opening, the openings in the panels being arranged with respect to one another and adapted in cross section to a flow-through volume of liquid therein so that a uniform branching arrangement of liquid distribution is provided within said liquid distribution chamber; the outflow openings of the panels terminating in a connecting slot of said liquid distribution device, said connecting slot extending over the working width of the device and being adjoined by a liquid outflow slot likewise extending over the working width of the device, said liquid outflow slot extending upwardly to the overflow weir.

2. A device according to claim 1, wherein a ratio between the cross section of the supply line and a working width of an individual liquid distribution chamber is 1:5 to 1:15.

3. A device according to claim 1 or 2, wherein the liquid distribution device comprises a plurality of said liquid distribution chambers arranged side by side in direct contact with one another, so that the liquid distribution device covers an entire working width of the web of goods.

4. A device according to claim 3, wherein the plurality of liquid distribution chambers are arranged on a common rail in the liquid distribution device.

5. A device according to claim 1, wherein the guide surface associated with said overflow weir has associated with it a plurality of liquid overflow openings, said openings being uniformly distributed over a working width of each liquid distribution chamber and wherein a height of the outflow slot is less than a width of the connecting slot.

6. A device according to claim 5, wherein a liquid supply line connected to a liquid distribution chamber has ten to at least twenty liquid outflow openings operatively associated therewith.

7. A device according to claim 6, wherein distribution of the liquid from the liquid supply line is performed in a plurality of stages up to the liquid outflow openings discharging to the connecting slot.

8. A device according to claim 7, wherein in the liquid distribution chamber, the liquid supply opening is connected on both sides in the direction of the working width of the chamber with a first branch line having ends at which intermediate outflow openings are provided.

9. A device according to claim 8, wherein said intermediate outflow openings each have connected thereto in the same fashion on both sides in a direction of the working width of the chamber, second branch lines, said second branch lines being only half the length of the first branch line, resulting in multiple dendriform branching of the liquid distribution within said chamber.

10. A device according to claim 8 or 9, wherein a cross section of each of the liquid outflow openings is reduced or halved by subsequent intermediate outflow openings and the respective flowing branch lines accordingly are made narrower in cross section.

11. The device according to claim 10, wherein the branch lines and the intermediate outflow openings are made in the form of holes in each panel, three such panels being pressed together to form at least one branch line.

12. A device according to claim 1, wherein the connecting slot is larger in cross section than liquid outflow openings discharging therein.

* * * * *